US005080072A

United States Patent [19]

Hosokai et al.

[11] Patent Number: 5,080,072

[45] Date of Patent: Jan. 14, 1992

[54] AIR-FUEL RATIO CONTROL SYSTEM FOR ENGINE

[75] Inventors: Tetsushi Hosokai; Tetsuro Takaba; Toshihiro Ishihara; Hideki Kobayashi, all of Hiroshima, Japan

[73] Assignee: Mazda Motor Corporation, Hiroshima, Japan

[21] Appl. No.: 623,529

[22] Filed: Dec. 7, 1990

[30] Foreign Application Priority Data

Dec. 8, 1989 [JP] Japan ..... 1-317811

[51] Int. Cl.[5] ..... F02D 41/14; F02D 41/22

[52] U.S. Cl. ..... 123/479; 123/489

[58] Field of Search ..... 123/440, 479, 489

[56] References Cited

U.S. PATENT DOCUMENTS 4,408,584 10/1983 Yabuhara et al. ..... 123/489 X
4,751,908 6/1988 Abe et al. ..... 123/479 X
5,020,499 6/1991 Kojima et al. ..... 123/479

FOREIGN PATENT DOCUMENTS 58-24610 5/1983 Japan .

*Primary Examiner*—Tony M. Argenbright
*Attorney, Agent, or Firm*—Sixbey, Friedman, Leedom & Ferguson

[57] ABSTRACT

An air-fuel ratio control system for an engine has an air-fuel ratio sensor which generates an output value which changes according to an air-fuel ratio in an air-fuel mixture fed to the engine. An upper preset value which corresponds to an output value of the air-fuel ratio sensor for an air-fuel ratio which is larger than a stoichiometric air-fuel ratio and a lower preset value which corresponds to an output value of the air-fuel ratio sensor for an air-fuel ratio which is smaller than the stoichiometric air-fuel ratio are set. They are respectively reduced and increased by a predetermined value at one time at regular intervals, and are shifted each time the output value of the air-fuel ratio sensor exceeds the upper preset value at that time and reduces below the lower preset value at that time, to the output value of the air-fuel ratio sensor at that time. It is determined that the air-fuel ratio sensor is abnormal when the difference between the upper and lower preset values becomes smaller than a predetermined reference difference.

5 Claims, 4 Drawing Sheets

AIR-FUEL RATIO CONTROL SYSTEM FOR ENGINE

BACKGROUND OF THE INVENTION

1. Field of the Invention

This invention relates to an air-fuel ratio control system for an engine, and more particularly to an air-fuel ratio control system for an engine in which an air-fuel ratio in an air-fuel mixture fed to the engine is detected by an air-fuel ratio sensor and the air-fuel ratio in an air-fuel mixture to be fed to the engine is controlled to converge on a target value on the basis of the detected air-fuel ratio.

2. Description of the Prior Art

In a recent electronic engine control, the air-fuel ratio in an air-fuel mixture to be fed to the engine is controlled in the following manner.

That is, the amount of fuel to be injected from a fuel injector provided in an intake system of an engine is controlled by a controller which comprises a microcomputer. The controller calculates a basic fuel injection amount (a basic value of the amount of fuel to be injected from the injector) on the basis of the amount of intake air detected by an airflow meter and an engine speed detected by an engine speed sensor, and produces various corrections such as a warming-up increase correction, a starting increase correction, an acceleration increase correction, a heavy load increase correction, an intake air temperature correction, an air-fuel ratio feedback correction and the like according to the operating condition of the engine, thereby determining a final fuel injection amount (a final value of the amount of fuel to be injected).

The feedback correction of the air-fuel ratio is performed on the basis of the output of an air-fuel ratio sensor (which may be of an $O_2$ sensor) which is provided in an exhaust system when the operating condition of the engine as determined, for instance, according to the engine speed and the engine load is in a predetermined feedback zone.

The $O_2$ sensor outputs a voltage the value of which increases as the air-fuel ratio decreases and greatly changes near the stoichiometric air-fuel ratio. The controller compares the output voltage of the $O_2$ sensor with a reference voltage which corresponds to the stoichiometric air-fuel ratio, and reduces the amount of fuel to be injected from the injector when the former is higher than the latter and increases the amount of fuel to be injected from the injector when the former is lower than the latter so that the air-fuel ratio approaches the stoichiometric air-fuel ratio.

In some of the conventional electronic control engines, the controller performs the following learning control together with the feedback correction in order to compensate for fluctuation in the basic air-fuel ratio due to variation and/or change with time in properties of various parts such as the engine, the airflow meter, the injector and the like.

While the feedback control is performed, the controller samples the average of the feedback correction values over a predetermined time at regular intervals and stores the up-to-date value of the average in a memory. The value stored in the memory is referred to as "a feedback correction learning value". The controller calculates the amount of fuel to be fed to the engine using also the feedback correction learning value as a parameter. This increases controlling accuracy of the air-fuel ratio. Further, by performing the learning control on the basis of the learning value stored in the memory while the feedback control is not performed, the air-fuel ratio can be caused to approach the stoichiometric air-fuel ratio.

Further, the controller also carries out the following abnormality processing relating to the feedback correction. That is, when the air-fuel ratio control is correctly performed, the output voltage of the $O_2$ sensor forms a waveform which oscillates up and down about the reference voltage. If the output voltage of the $O_2$ sensor is fixed to the higher level side or the lower level side for a long time and does not change, it can be considered that the $O_2$ sensor is cold and is not active yet, or the $O_2$ sensor itself fails or the air-fuel ratio control system fails. Accordingly, when the output voltage of the $O_2$ sensor does not change across the reference voltage for a predetermined time (e.g., 10 seconds), the controller determines that the feedback control system including the $O_2$ sensor is abnormal and interrupts the feedback correction of the air-fuel ratio.

In Japanese Patent Publication No. 58(1983)-24610, it is proposed to set the reference voltage for determining whether the $O_2$ sensor is active at a value which is different from the conventional reference voltage described above and conforms to the particular engine in order to accurately determine whether the $O_2$ sensor is active and to quickly start or interrupt the feedback correction.

However, when whether the $O_2$ sensor is active is determined on the basis of whether the output voltage of the $O_2$ sensor does not change across a particular reference voltage for a predetermined time, it is difficult to set the reference voltage and/or the predetermined time so that the feedback control of the air-fuel ratio can be performed for a long time with high stability and reliability.

That is, when the reference voltage is set at a low value, minute noise in the output level can exceed the reference voltage even if the $O_2$ sensor is not active, which can lead to misjudgement and delay in detecting an abnormality. On the other hand, when the reference voltage is set at a high value, it takes a long time to determine that the $O_2$ sensor becomes active and the feedback control cannot be quickly started.

Further when said predetermined time is short, there arises a problem when the learning control is performed. That is, when the feedback correction learning value is cleared in response to, for instance, disconnection of the battery, the output voltage of the $O_2$ sensor can be fixed to an upper limit value or a lower limit value until the feedback correction learning value is reset to a reasonable value. Accordingly, when said predetermined time is short, the feedback correction is interrupted in such a case, and the feedback correction learning value cannot be updated, which can lead to a state in which the feedback correction and the learning control cannot be started. On the other hand, when the predetermined time is long, it takes a long time to detect that the $O_2$ sensor and/or the control system fails.

SUMMARY OF THE INVENTION

In view of the foregoing observations and description, the primary object of the present invention is to provide an air-fuel ratio control system for an engine which can more accurately determine whether the air-fuel ratio sensor is active and/or whether the air-fuel ratio control system is abnormal, thereby controlling the air-fuel ratio with a higher accuracy.

In accordance with the present invention, there is provided an air-fuel ratio control system for an engine comprising an air-fuel ratio sensor which generates an output value which changes according to an air-fuel ratio in an air-fuel mixture fed to the engine, a feedback control means which causes the air-fuel ratio in the air-fuel mixture fed to the engine to converge on a target air-fuel ratio by feedback correction on the basis of the output value of the air-fuel ratio sensor, a sensor abnormality detecting means which detects that the air-fuel ratio sensor is abnormal, and a feedback correction inhibiting means which inhibits the feedback control means from effecting the feedback correction when the sensor abnormality detecting means detects that the air-fuel ratio sensor is abnormal, characterized in that said sensor abnormality detecting means determines that the air-fuel ratio sensor is abnormal by the steps of setting an upper preset value which corresponds to an output value of the air-fuel ratio sensor for an air-fuel ratio which is larger than a stoichiometric air-fuel ratio by a predetermined value and a lower preset value which corresponds to an output value of the air-fuel ratio sensor for an air-fuel ratio which is smaller than the stoichiometric air-fuel ratio by a predetermined value, reducing the upper preset value by a predetermined value at one time at regular intervals, and increasing the lower preset value by a predetermined value at one time at the regular intervals, shifting the upper preset value, each time the output value of the air-fuel ratio sensor exceeds the upper preset value at that time, to the output value of the air-fuel ratio sensor at that time and reducing the upper preset value from the shifted value by the predetermined value at one time at regular intervals, shifting the lower preset value, each time the output value of the air-fuel ratio sensor reduces below the lower preset value at that time, to the output value of the air-fuel ratio sensor at that time and increasing the lower preset value from the shifted value by the predetermined value at one time at regular intervals, and continuously detecting the difference between the upper and lower preset values and determining that the air-fuel ratio sensor is abnormal when the difference between the upper and lower preset values becomes smaller than a predetermined reference difference.

Generally the maximum output value of the air-fuel ratio is gradually lowered and the minimum output value of the same is gradually increased, whereby the amplitude of the oscillation of the output value becomes smaller as the air-fuel ratio sensor deteriorates with time. Accordingly, when the air-fuel ratio sensor deteriorates to a certain extent, the upper preset value which is gradually reduced and is increased each time the output value of the air-fuel ratio exceeds it becomes unable to be increased, and the lower preset value which is gradually increased and is reduced each time the output value of the air-fuel ratio reduced below it becomes unable to be reduced. Thus by watching the difference between the upper preset value and the lower preset value, abnormality of the air-fuel ratio sensor itself and abnormality in the air-fuel ratio control system can be detected.

In accordance with the arrangement of the present invention, relatively small noise in the output level generated while the air-fuel ratio sensor is inactive cannot adversely affect the determination of whether the air-fuel ratio sensor is inactive. Further, with the arrangement described above, the system does not determine that the air-fuel ratio fails as soon the feedback correction learning value is cleared and the output voltage of the air-fuel ratio sensor is fixed to the upper limit value or the lower limit value. Accordingly, the feedback correction is not interrupted soon and a state in which the feedback correction and the learning control cannot be started can be avoided.

DESCRIPTION OF THE PREFERRED EMBODIMENT

Figure 1:
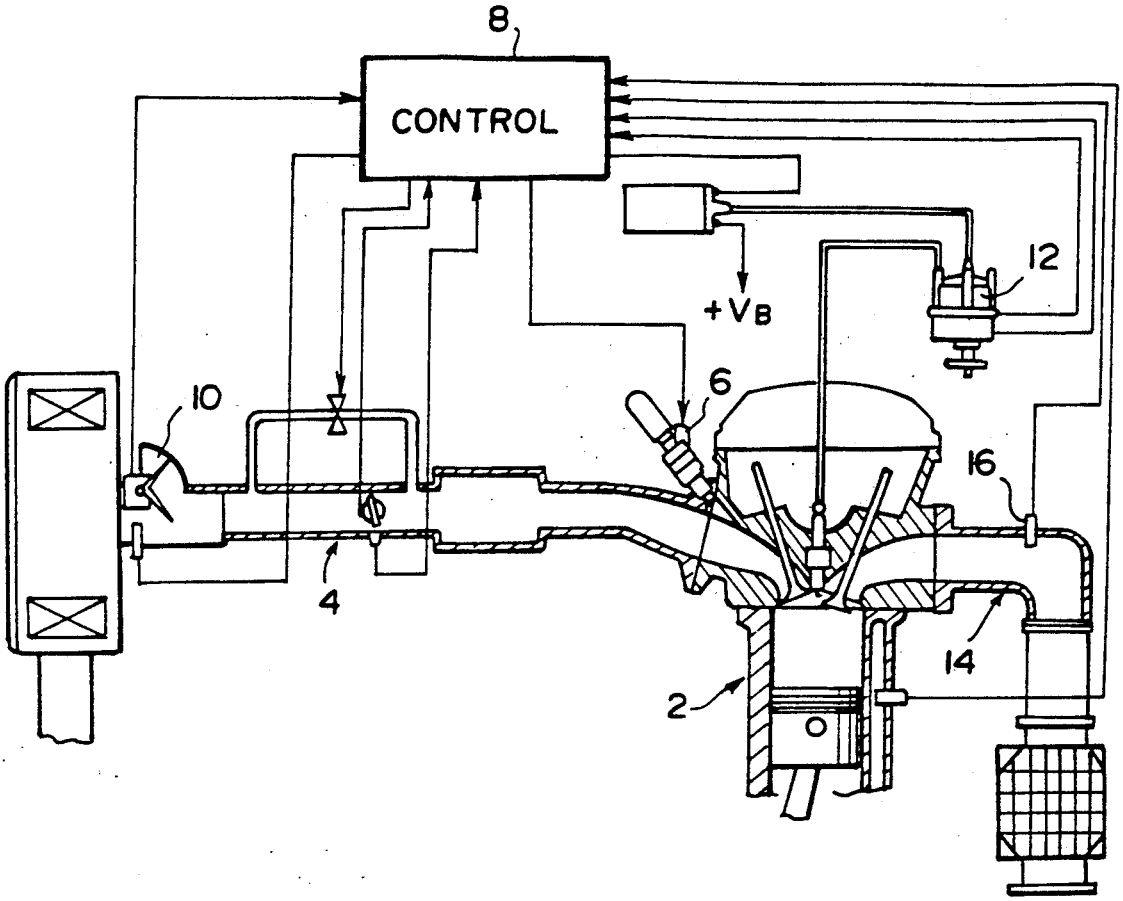
FIG. 1 is a schematic view showing an engine provided with an air-fuel ratio control system in accordance with an embodiment of the present invention.

In FIG. 1, an engine 2 has an intake passage 4 and an exhaust passage 14. An $O_2$ sensor 16 is disposed in the exhaust passage 14 and an airflow meter 10 is disposed in the intake passage 4. Reference numerals 6 and 12 respectively denote a fuel injector and an engine speed sensor. The outputs of the $O_2$ sensor 16, the airflow meter 10 and the engine speed sensor 12 are input into a controller 8 which may be of a microcomputer.

The air-fuel ratio control system of this embodiment mainly characterized by the manner for determining whether the $O_2$ sensor 16 is active or inactive. That is, the controller 8 determines that the $O_2$ sensor 16 is inactive when the difference between a maximum value Vamax of the output voltage Va of the $O_2$ sensor 16 and a minimum value Vamin of the same is smaller than a predetermined value.

Figure 2:
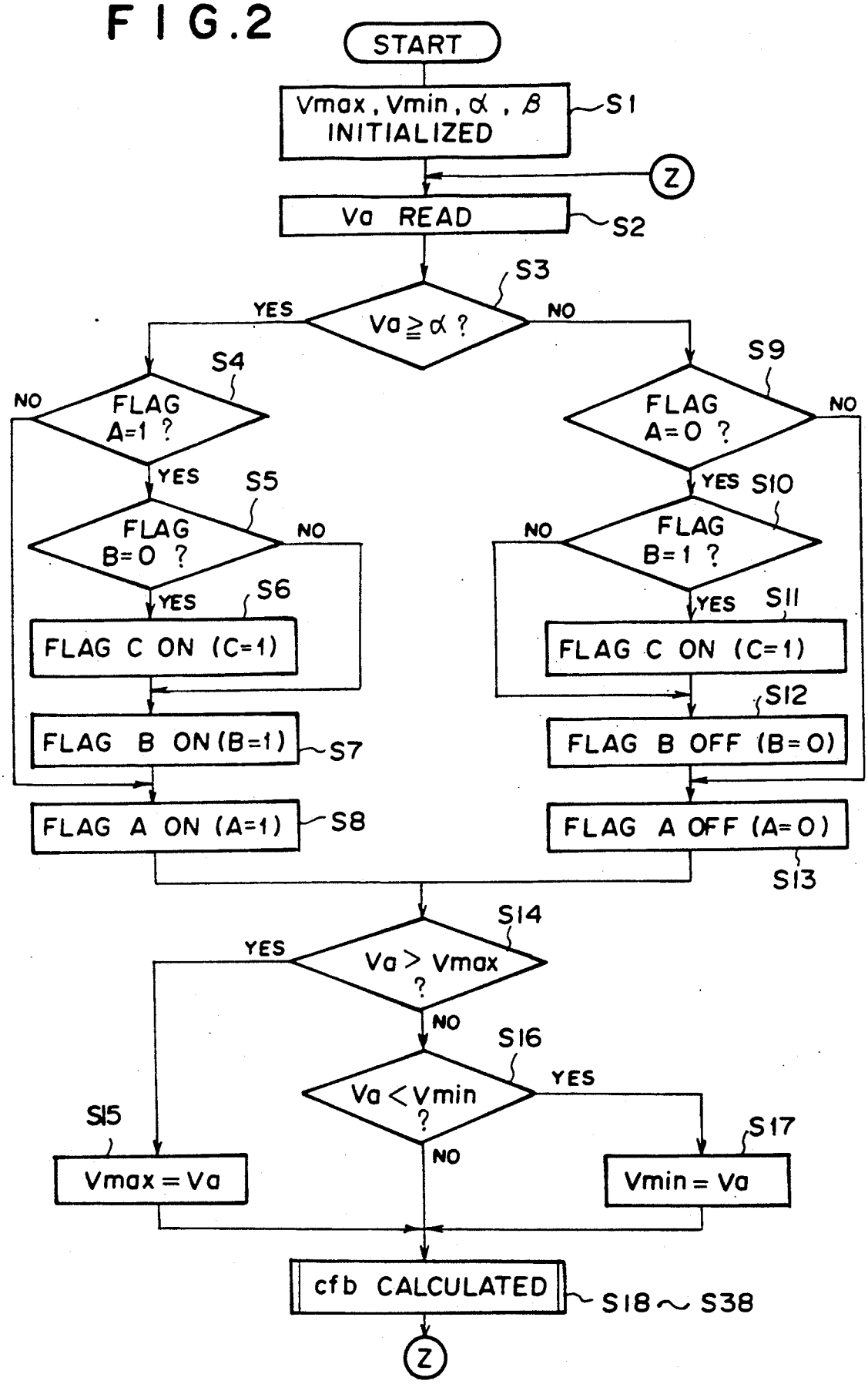
FIGS. 2 and 3 are flow charts for performing the air-fuel ratio control in the embodiment.

The operation of the controller 8 will be described with reference to FIGS. 2 and 3, hereinbelow.

The controller 8 initializes a preset maximum output value Vmax and a preset minimum output value Vmin (the purpose of which will become apparent later) for the purpose of simplicity. Further the controller 8 sets a reference difference value $\beta$ for decision of whether the $O_2$ sensor 16 is active or inactive and a reference voltage $\alpha$ corresponding to the stoichiometric air-fuel ratio. (step S1)

Then the controller 8 reads the output voltage Va of the $O_2$ sensor 16 and determines whether the output voltage Va is not lower than the reference voltage $\alpha$, thereby determining whether the detected air-fuel ratio is rich or lean. (steps S2 and S3) When it is determined in step S3 that the output voltage Va is not lower than the reference voltage $\alpha$, i.e., the air-fuel ratio is rich, the controller 8 proceeds to step S4, and otherwise the controller 8 proceeds to step S9. In step S4, the controller 8 determines whether flag A is on (A=1), that the flag A is on indicating that the air-fuel ratio at the last determination was rich and that the flag A is off (A=0) indicating that the air-fuel ratio at the last determination was lean. When it is determined in step S4 that the flag A is off, the controller 8 directly proceeds to step S8 and sets the flag A on. Thereafter, the controller 8 proceeds to an update routine for updating the preset maximum output value Vmax and the preset minimum output value Vmin (steps S14 to S17).

When it is determined in step S4 that the flag A is on, i.e., the air-fuel ratio at the last determination was also rich, the controller 8 determines in step S5 whether flag B is off (B=0), that the flag B is on (B=1) indicating that the air-fuel ratio at the second last determination was rich and that the flag B is off (B=0) indicating that the air-fuel ratio at the second last determination was lean. When it is determined in step S5 that the air-fuel ratio at the second last determination was (B=0), i.e., when the output voltage Va of the $O_2$ sensor 16 indicated that the air-fuel ratio is rich at successive two determinations, the present determination and the last determination, after the air-fuel ratio turned rich, the controller 8 determines that the air-fuel ratio has certainly turned rich and proceeds to step S6. In step S6, the controller 8 sets flag C on (C=1). When the flag C is on (C=1), the controller 8 selects proportional control over integral control in a calculation routine (steps S18 to S31 in FIG. 3) for calculating a feedback correction coefficient Cfb for air-fuel ratio. On the other hand, when the flag C is off (C=0), the controller 8 selects the integral control over the proportional control in the calculation routine. After step S6, the controller 8 sets the flag B on (B=1) in step S7 and proceeds to step S8.

On the other hand, when it is determined in step S5 that the air-fuel ratio at the second last determination was also rich (B=1), the controller 8 determines that the air-fuel ratio has been rich steady and directly proceeds to step S7 without performing step S6 so that the integral control is selected in the calculation routine. As will be described later, the flag C is kept off (C=0) so long as the controller 8 does not perform step S6.

When it is determined in step S3 that the output voltage Va is lower than the reference voltage $\alpha$, i.e., the air-fuel ratio is lean, the controller 8 proceeds to step S9. In step S9, the controller 8 determines whether flag A is off (A=0). When it is determined in step S9 that the flag A is on, the controller 8 directly proceeds to step S13 and sets the flag A off. Thereafter, the controller 8 proceeds to the update routine for updating the preset maximum output value Vmax and the preset minimum output value Vmin (steps S14 to S17).

When it is determined in step S9 that the flag A is off, i.e., the air-fuel ratio at the last determination was also lean, the controller 8 determines in step S10 whether flag B is on (B=1). When it is determined in step S10 that the air-fuel ratio at the second last determination was rich (B=1), i.e., when the output voltage Va of the $O_2$ sensor 16 indicated that the air-fuel ratio is lean at successive two determinations, the present determination and the last determination, after the air-fuel ratio turned lean, the controller 8 determines that the air-fuel ratio has certainly turned lean and proceeds to step S11. In step S11, the controller 8 sets flag C on (C=1). After step S11, the controller 8 sets the flag B off (B=0) in step S12 and proceeds to step S13.

On the other hand, when it is determined in step S10 that the air-fuel ratio at the second last determination was also lean (B=0), the controller 8 determines that the air fuel ratio has been lean steady and directly proceeds to step S12 without performing step S11 so that the integral control is selected in the calculation routine. The flag C is kept off (C=0) so long as the controller 8 does not perform step S11.

In the update routine, the controller 8 determines in step S14 whether the output voltage Va of the $O_2$ sensor 16 as read in step S3 is higher than the preset maximum output value Vmax. When it is determined that the former is higher than the latter, the controller 8 proceeds to step S15 and updates the preset maximum output value Vmax by substituting the former for the latter. Thereafter the controller 8 proceeds to the calculation routine.

When it is determined that the output voltage Va of the $O_2$ sensor 16 is not higher than the preset maximum output value Vmax, the controller 8 proceeds to step S16 and determines whether the output voltage Va of the $O_2$ sensor 16 as read in step S3 is lower than the preset minimum output value Vmin. When it is determined that the former is lower than the latter, the controller 8 proceeds to step S17 and updates the preset minimum output value Vmin by substituting the former for the latter. Thereafter the controller 8 proceeds to the calculation routine. When it is determined that the output voltage Va of the $O_2$ sensor 16 is not lower than the preset minimum output value Vmin, the controller 8 directly proceeds to the calculation routine.

Figure 3:
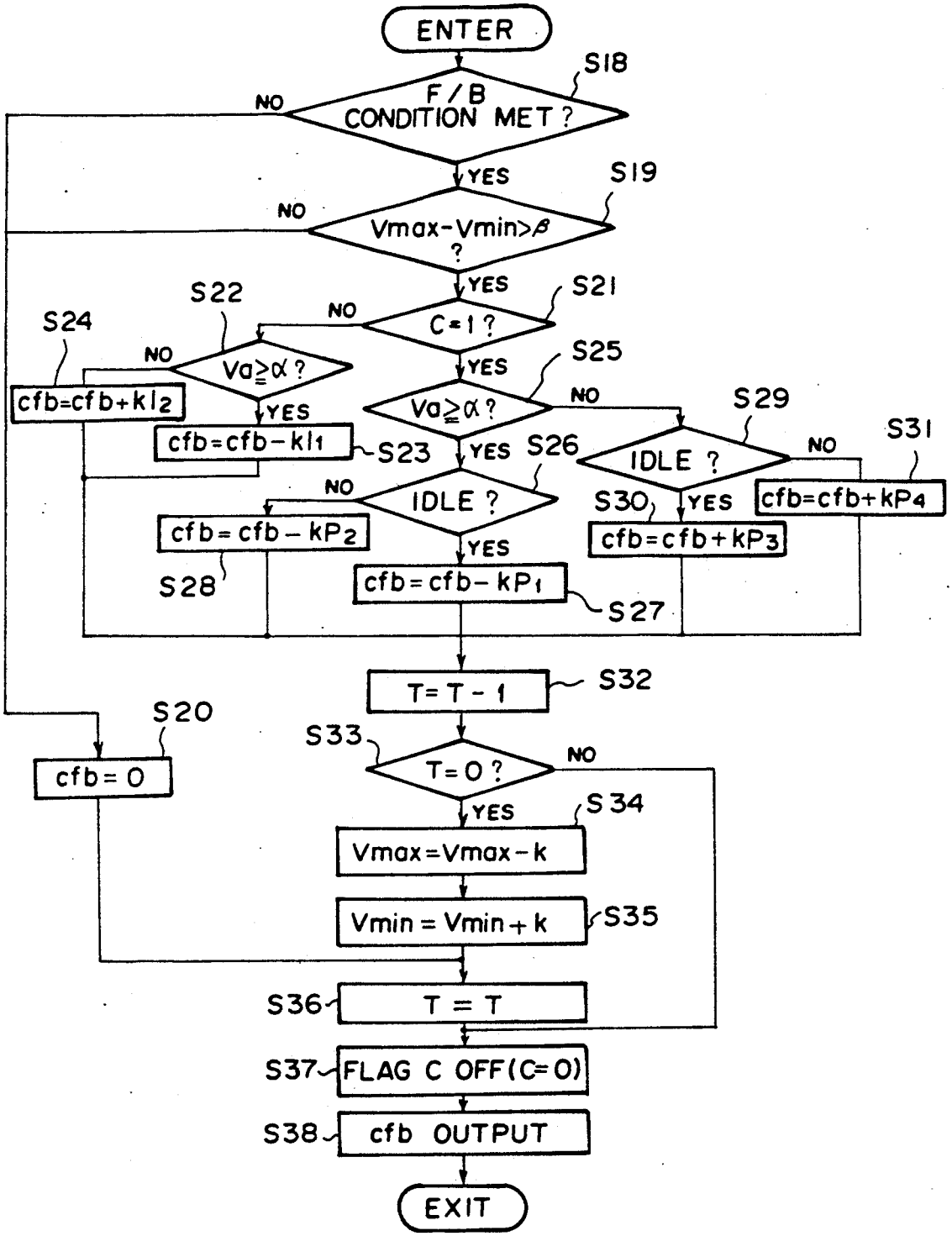

In the calculation routine shown in FIG. 3, the controller 8 determines in step S18 whether the operating condition of the engine 2 has satisfied the requirements of performing the feedback control of the air-fuel ratio. When it is determined that the requirements of performing the feedback control of the air-fuel ratio has not been satisfied, the controller 8 proceeds to step S20 and sets the feedback correction coefficient Cfb at 0. Thereafter, the controller 8 directly proceeds to step S36.

On the other hand, when it is determined in step S18 that the requirements of performing the feedback control of the air-fuel ratio has been satisfied, the controller 8 proceeds to step S19 and the controller 8 determines whether the difference between the preset maximum output value Vmax and the preset minimum output value Vmin is smaller than the reference difference value $\beta$ thereby determining whether the $O_2$ sensor 16 is active and is normally operating. When it is determined that the $O_2$ sensor 16 is not operating normally, the controller 8 proceeds to step S20 described above. Otherwise, the controller 8 proceeds to step S21 and determines whether the flag C is on (C=1).

When it is determined that the flag C is off (C=0), the controller 8 proceeds to step S22 of the integral control routine (steps S22 to S24) and determines whether the air-fuel ratio is rich. When it is determined that the air-fuel ratio is rich, the controller 8 proceeds to step S23 and calculates the present value of the feedback correction coefficient Cfb by subtracting a predetermined integral value kI1 from the preceding value of the feedback correction coefficient Cfb. Thereafter, the controller 8 proceeds to a gradual reduction and increase routine (steps S32 to S37) for gradually reducing and increasing the preset maximum output value Vmax and the preset minimum output value Vmin which will be described later. On the other hand, when it is determined in step S22 that the air-fuel ratio is lean, the controller 8 proceeds to step S24 and calculates the present value of the feedback correction coefficient Cfb by adding a predetermined integral value kI2 to the preceding value of the feedback correction coefficient Cfb. Then the controller 8 proceeds to the gradual reduction and increase routine. The controller 8 enters the integral control routine in the case where the air-fuel ratio is rich or lean steady or in the case of a first flow immediately after the output voltage Va of the $O_2$ sensor 16 changes across the reference voltage $\alpha$. In the first flow immediately after the air-fuel ratio turns rich or lean, the controller 8 considers that the change of the output voltage Va of the $O_2$ sensor 16 is produced due to noise and continues the integral control determines in the preceding flow.

When it is determined in step S21 that the flag C is on (C=1), the controller 8 proceeds to step S25 of the proportional control routine (steps S25 to S31) and determines whether the air-fuel ratio is rich. When it is determined that the air-fuel ratio is rich, the controller 8 proceeds to step S26 and determines whether the engine 2 is idling. When it is determined that the engine 2 is idling, the controller 8 proceeds to step S27 and calculates the present value of the feedback correction coefficient Cfb by subtracting a predetermined proportional value kP1 from the preceding value of the feedback correction coefficient Cfb. Thereafter, the controller 8 proceeds to the gradual reduction and increase routine (steps S32 to S37). On the other hand, when it is determined in step S26 that the engine 2 is not idling, the controller 8 proceeds to step S28 and calculates the present value of the feedback correction coefficient Cfb by subtracting a predetermined proportional value kP2 (kP2>kP1) from the preceding value of the feedback correction coefficient Cfb. Thereafter, the controller 8 proceeds to the gradual reduction and increase routine (steps S32 to S37).

When it is determined in step S25 that the air-fuel ratio is lean, the controller 8 proceeds to step S29 and determines whether the engine 2 is idling. When it is determined that the engine 2 is idling, the controller 8 proceeds to step S30 and calculates the present value of the feedback correction coefficient Cfb by adding a predetermined proportional value kP3 to the preceding value of the feedback correction coefficient Cfb. Thereafter, the controller 8 proceeds to the gradual reduction and increase routine (steps S32 to S37). On the other hand, when it is determined in step S29 that the engine 2 is not idling, the controller 8 proceeds to step S31 and calculates the present value of the feedback correction coefficient Cfb by adding a predetermined proportional value kP4 (kP4>kP3) to the preceding value of the feedback correction coefficient Cfb. Thereafter, the controller 8 proceeds to the gradual reduction and increase routine (steps S32 to S37).

In the gradual reduction and increase routine, the controller 8 count downs a timer (T=T−1) in step S32, and then the controller 8 directly proceeds to step S37 until the counter is decremented to 0. (step S33) When the timer is decremented to 0, the controller 8 proceeds to steps S34 and S35 and reduces the preset maximum output value Vmax by a predetermined value k at one time and increases the preset minimum output value Vmin by the predetermined value k at one time. Then in the next step S36, the controller 8 substitutes a new value for 0 as the value of the timer (T=T), and sets the flag C off (C=0) in step S37. Thereafter the controller 8 outputs, in step S38, the value of the feedback correction coefficient Cfb thus obtained to a main routine for controlling the amount of fuel to be injected from the injector 6 and then returns to step S2 shown in FIG. 2. In the main routine for controlling the amount of fuel to be injected from the injector 6, a basic fuel injection amount calculated in the main routine is corrected on the basis of the value of the feedback correction coefficient Cfb and then fuel is injected from the injector 6.

The new value which is substituted for 0 as the value of the timer is 5, for instance, and the preset maximum output value Vmax and the preset minimum output value Vmin are respectively reduced and increased each time the control described above is repeated five times. The controller 8 directly proceeds to step S36 after step S20 where it sets the feedback correction coefficient Cfb at 0 and interrupts the feedback control of the air-fuel ratio. In this case, the preset maximum output value Vmax and the preset minimum output value Vmin are nod gradually reduced or increased and held at the preceding value. Further, the new value is substituted for the value of the timer every time. The flow described above is repeated at a sufficiently short cycle.

Figure 4:
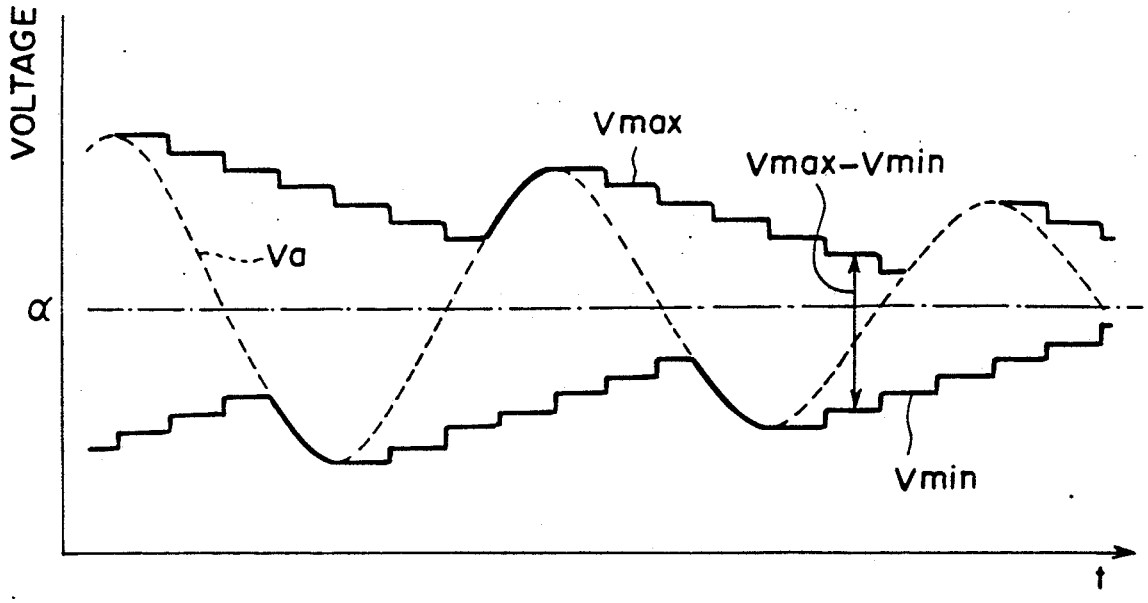
FIG. 4 is a view for illustrating the manner for determining whether the $O_2$ sensor is active or inactive in the embodiment.

In the embodiment described above, the preset maximum output value Vmax and the preset minimum output value Vmin are gradually reduced and decreased with time respectively as shown in FIG. 4, whereby the difference therebetween Vmax-Vmin is gradually reduced. However, each time the output voltage Va of the $O_2$ sensor 16 which oscillates up and down about the reference voltage $\alpha$ exceeds the value of the preset maximum output value Vmax at that time, the value of the preset maximum output value Vmax is increased again and each time the output voltage Va of the $O_2$ sensor 16 lowers below the value of the preset minimum output value Vmin at that time, the value of the preset minimum output value Vmin is reduced again, whereby the difference Vmax-Vmin is repeatedly increased. However, as the amplitude of the oscillation of the output voltage Va of the $O_2$ sensor 16 is reduced due to deterioration with time of the $O_2$ sensor 16, the preset maximum output value Vmax and the preset minimum output value Vmin cannot return to the original values and the difference Vmax-Vmin is gradually reduced and can finally become smaller than the reference difference $\beta$. Further, when the temperature of the $O_2$ sensor 16 is low and the $O_2$ sensor 16 is in inactive state, or breaking of wire occurs, or the output voltage Va of the $O_2$ sensor 16 is fixed to the maximum value Vamax or the minimum value Vamin, the difference Vmax-Vmin is gradually reduced and can finally become smaller than the reference difference $\beta$. Accordingly, by continuously detecting the difference Vmax-Vmin, abnormality of the $O_2$ sensor 16 itself and abnormality in the air-fuel ratio control system can be detected. Further when the difference between the output voltage Va of the $O_2$ sensor 16 in an inactive state and the maximum value Vamax or the minimum value Vamin of the output voltage Va is sufficiently large, or when the difference between the preset maximum output value Vmax and the maximum value Vamax or the difference between the preset minimum output value Vmin and the minimum value Vamin is sufficiently large, the time interval between the time the output voltage of the $O_2$ sensor 16 is fixed to the maximum value Vamax or the minimum value Vamin and the time the feedback correction is interrupted can be sufficiently long, and accordingly, a state in which the feedback correction and the learning control cannot be started can be avoided.

Though, in the embodiment described above, the present invention is applied to a fuel injection type electronic control engine, the present invention may also be applied to a carburetor type electronic control engine.

We claim:

1. An air-fuel ratio control system for an engine comprising an air-fuel ratio sensor which generates an output value which changes according to an air-fuel ratio in an air-fuel mixture fed to the engine, a feedback control means which causes the air-fuel ratio in the air-fuel mixture fed to the engine to converge on a target air-fuel ratio by feedback correction on the basis of the output value of the air-fuel ratio sensor, a sensor abnormality detecting means which detects that the air-fuel ratio sensor is abnormal, and a feedback correction inhibiting means which inhibits the feedback control means from effecting the feedback correction when the sensor abnormality detecting means detects that the air-fuel ratio sensor is abnormal, characterized in that said sensor abnormality detecting means determines that the air-fuel ratio sensor is abnormal by the steps of setting an upper preset value which corresponds to an output value of the air-fuel ratio sensor for an air-fuel ratio which is larger than a stoichiometric air-fuel ratio by a predetermined value and a lower preset value which corresponds to an output value of the air-fuel ratio sensor for an air-fuel ratio which is smaller than the stoichiometric air-fuel ratio by a predetermined value, reducing the upper preset value by a predetermined value at one time at regular intervals, and increasing the lower preset value by a predetermined value at one time at the regular intervals, shifting the upper preset value, each time the output value of the air-fuel ratio sensor exceeds the upper preset value at that time, to the output value of the air-fuel ratio sensor at that time and reducing the upper preset value from the shifted value by the predetermined value at one time at regular intervals, shifting the lower preset value, each time the output value of the air-fuel ratio sensor reduces below the lower preset value at that time, to the output value of the air-fuel ratio sensor at that time and increasing the lower preset value from the shifted value by the predetermined value at one time at regular intervals, and continuously detecting the difference between the upper and lower preset values and determining that the air-fuel ratio sensor is abnormal when the difference between the upper and lower preset values becomes smaller than a predetermined reference difference.

2. An air-fuel ratio control system as defined in claim 1 in which said feedback control means effects a proportional control in order to cause the air-fuel ratio to converge on the target air-fuel ratio when the output of the air-fuel ratio is kept lean or rich a predetermined time after it turns lean or rich.

3. An air-fuel ratio control system as defined in claim 2 in which said feedback control means effects an integral control in order to cause the air-fuel ratio to converge on the target air-fuel ratio when the output of the air-fuel ratio is kept lean or rich more than said predetermined time after it turns lean or rich.

4. An air-fuel ratio control system as defined in claim 1 in which said upper and lower preset values are respectively reduced and increased each time the difference between the upper and lower preset values is detected a predetermined number of times.

5. An air-fuel ratio control system as defined in claim 1 in which said air-fuel ratio sensor is an $O_2$ sensor.

* * * * *